United States Patent [19]

Bertoni

[11] Patent Number: 5,005,229

[45] Date of Patent: Apr. 9, 1991

[54] SWIMMING POOL ROPE ANCHOR METHOD AND DEVICE

[76] Inventor: Italo A. Bertoni, 305 Edinborough Street, Windsor, Ontario, Canada, N8X 3C3

[21] Appl. No.: 461,256

[22] Filed: Jan. 5, 1990

[51] Int. Cl.[5] ..... E04H 4/00

[52] U.S. Cl. ..... 4/505; 4/496; 4/497; 4/504; 52/704; 52/707; 403/343

[58] Field of Search ..... 4/496–497, 4/503, 504, 506, 507, 661; 52/704, 706, 707; 403/201, 343

[56] References Cited

U.S. PATENT DOCUMENTS

| | | | |
|---|---|---|---|
| 3,065,576 | 11/1962 | Prizler et al. | 4/506 X |
| 3,443,351 | 5/1969 | Kumazawa | 52/704 |
| 3,868,732 | 3/1975 | Englehart | 4/496 |
| 3,972,077 | 8/1976 | Whitten, Jr. | 4/496 |
| 4,004,301 | 1/1977 | Kaufman | 4/496 |
| 4,523,413 | 6/1985 | Koppenberg | 52/704 X |
| 4,561,134 | 12/1985 | Mathews et al. | 4/503 |

*Primary Examiner*—Henry K. Artis

[57] ABSTRACT

A rope anchor device for a swimming pool having a vinyl liner wherein a flat base plate has at least two integral stems projecting rearwardly from the plate and extending through the swimming pool wall. A nut is threaded on each stem at the back or outside of the swimming pool wall to mount the plate securely against the inside of the swimming pool wall. A rope anchor eyelet plate is in turn mounted on the base plate, with the linear clamped therebetween, by at least two threaded fasteners which engage the anchor plate and are threadably engaged in bores extending coaxially through the stems. The base plate can be made of cast and machined metal or injection molded plastic. Where the base plate is made of metal, the bores are internally threaded. Where the base plate is made of injection molded plastic, self-tapping screws can be used and hence the bores need not be internally threaded.

5 Claims, 1 Drawing Sheet

SWIMMING POOL ROPE ANCHOR METHOD AND DEVICE

FIELD OF INVENTION

This invention relates to a rope anchor for swimming pools and more particularly to a safety rope anchor attached to a wall of a vinyl lined swimming pool.

BACKGROUND AND SUMMARY OF THE INVENTION

Vinyl lined swimming pools generally must have the liner replaced periodically due to normal wear or abuse. This requires the removal of various anchoring devices and pool accessories attached to the vinyl lined metal walls of the swimming pool. After a new liner has been installed, frequently these same anchoring devices and pool accessories are then reattached in the same location. Generally a concrete deck is placed around the perimeter of the pool, preventing easy access to the back side of the swimming pool wall and to nuts or other devices at the back side which hold the anchoring device against the opposite exposed front side of the wall. Consequently, the reinstallation of the anchoring device to the outside of the wall is very difficult and time consuming, particularly if some of the concrete decking has to be removed.

Both Engelhart U.S. Pat. No. 3,868,732 and Kaufman U.S. Pat. No. 4,004,301 disclose devices intended to avoid such problems associated with replacing the vinyl liner.

The Engelhart '732 device includes an externally and internally threaded sleeve having a large flange at one end that abuts against the exposed face of the pool wall. The sleeve extends through and is fixedly attached to the pool wall so that it remains in place during replacement of the liner. After the replacement of the liner, a shank of the anchor goes through the pool liner and is received by the internal threads of the sleeve.

The Kaufman '301 patent discloses an eyelet arrangement having a stem member which includes a large externally threaded portion and a smaller externally threaded portion. The smaller external portion is received through a hole in the pool wall and is held securely to the wall. The large portion of the stem extends into the swimming pool and through a hole in the liner. A gasket is placed over the enlarged portion and has a washer placed over it against the vinyl-liner and compressed by an eye having an internally threaded socket which is threaded onto the enlarged portion of the stem and held in secured attachment.

Both prior art devices require specially manufactured and machined parts. Both devices provide limited support and strength through a single hole in the swimming pool wall. Additionally, if the anchor eyelet is rotated, the eyelet may become unintentionally unthreaded. It is even possible, as by rotation of the rope or a child playing with the eyelet, that the threaded stem or threaded shank could become unthreaded from the nut at the back side of the pool wall. It is also difficult to maintain a preselected final orientation of the eyelet. Because only a single fastener is used through the swimming pool wall, there is some limitation on the clamping and pulling forces that can be achieved and the clamping and pulling forces are concentrated about the single hole through the wall.

Although multiple fastener anchor plates have been used commercially they have disadvantages. The multiple fastener base plate is fastened on the back or outside of the wall and is generally inaccessible after the pool installation is complete. An eyelet anchor is aligned with and fastened to the base by separate screws on the inside of the wall. This initial installation is difficult because of the need to properly align the eyelet anchor with the base plate through holes in the pool wall. When the liner needs to be replaced, it may be difficult to properly locate holes for mounting of the eyelet anchor on the inside of the pool wall or punching holes in the vinyl liner that are aligned with the base plate on the backside of the wall. Adding to the difficulty is the possibility that the base plate is no longer aligned with the holes in the pool wall. Thus, there is still a need for an anchoring device which firmly and effectively attaches to a swimming pool wall, cannot be removed inadvertently and can be manufactured economically.

Therefore, it is an object of this invention to provide an improved anchoring device for vinyl lined swimming pools that provides an effective safety rope anchor; that is stable and remains fixed in place; that is easy to install with simple tools; and that can be manufactured easily and economically.

It is a principal feature of this invention to employ more than one support extending through and fixed to the swimming pool wall so that the rope anchor is firmly secured to the swimming pool wall and can not be removed inadvertently.

A rope anchor device in accordance with the present invention includes a flat base plate having at least two integral stems rearwardly projecting from said plate, a first fastener for each stem, a rope anchor eyelet and second fastener means for securing the anchor to the base. The first fastener captures each stem at the outside of the swimming pool wall, and holds the plate against the inside of the swimming pool wall. An important advantage of this invention is that it provides a stable and strong support against the swimming pool wall.

The second fastener means in the preferred embodiment of the invention, in accordance with a second important aspect thereof, includes at least two bores through the base plate and extending through the center of each stem and a pair of screws which are receivable by the anchor and engageable with the bores. This second fastener means prevents any inadvertent loosening or removal of the anchor from the base and swimming pool wall. This second fastener means also provides stable and strong support to the base.

Other objects and features of the invention will be apparent in the following description and claims in which the invention is described together with the details to enable persons skilled in the art to practice the invention all in connection with the bast mode presently contemplated for the invention.

BRIEF DESCRIPTION OF THE DRAWINGS

Drawings accompanying the disclosure, and the various views thereof may be briefly described as.

DETAILED DESCRIPTION

Figure 1:
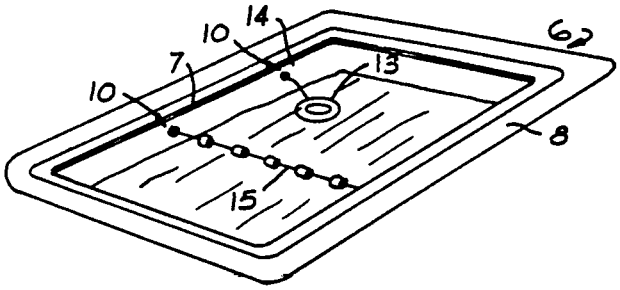
FIG. 1 is a perspective view of a vinyl lined swimming pool having anchoring devices of the present invention installed therein.

Referring first to FIG. 1, a typical swimming pool generally denoted as 6 is illustrated as including coping 7 surrounded by a concrete deck 8. Pool 6 has a vinyl liner 14 that forms the walls and floor of the pool and is attached to coping 7 by conventional means, the details of which are not essential to the present invention. Typically coping 7 may be attached to or integral with the upper edge of the metal frame wall 12 and a bead on the liner inserted in a reentrant groove in the coping as shown generally in FIG. 2. Anchoring devices 10 of the present invention are disposed at selected locations around the swimming pool 6 to anchor swimming pool accessories in place, such as a life preserver 13 and a safety rope 15 which divides the deep section of the pool 6 from the shallow section.

Figure 2:
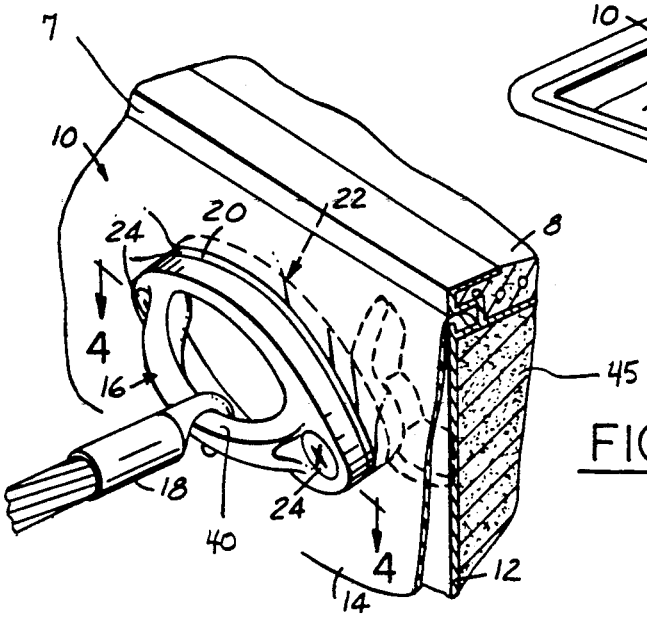
FIG. 2 is a fragmentary perspective view of an exemplary but preferred embodiment of a rope anchor device of this invention where an anchor base is injection molded plastic.
Figure 3:
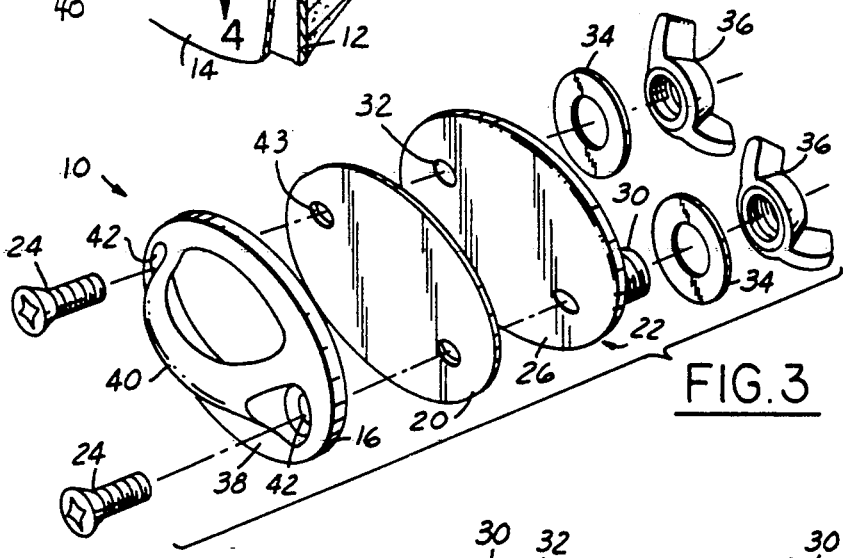
FIG. 3 is an exploded perspective view of the rope anchor device of FIG. 2.
Figure 4:
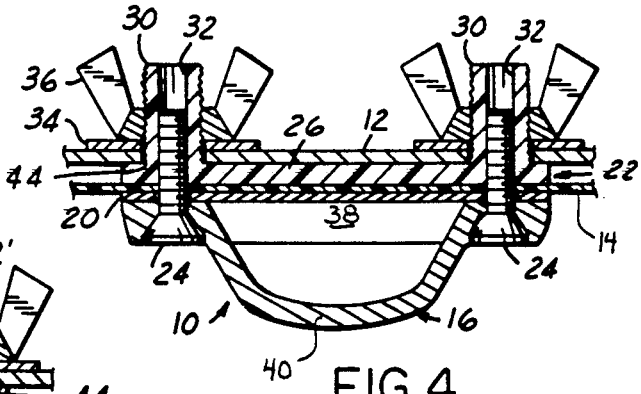
FIG. 4 is a sectional view taken along line 4—4 in FIG. 2.

Each of the swimming pool anchor devices 10, as shown in greater detail in FIGS. 2–4, comprises a eye plate 16, a gasket 20 and mounting base 22. Safety rope 15 has a rope hook 18 attached to eye plate 16. The anchor base 22 has a flat plate portion 26 and a pair of integral stems 30 extending rearwardly from plate 26 a length greater than the thickness of the pool wall 12. Anchor base 22 has a pair of smooth bores 32 extending through plate 26 and coaxially through respective stems 30. Eye plate 16 is fastened on base 22, with gasket 20 and liner 14 clamped therebetween, by two self-tapping screws 24 threaded respectively into the two bores 32. Stems 30 are externally threaded and each stem 30 receives a washer 34 and a nut 36 to fasten base 22 firmly on wall 12. Preferably nut 36 is a wing nut which can be tightened on stem 30 by hand. Wing nut 36 is preferably made of plastic, such as nylon.

Preferably, the anchor base 22 is made of polycarbonate resin, such as Lexan ®, and injection molded. Injection molded plastic is preferred for higher volume residential use because it can be made more economically. Although base 22 has been described as having two integral stems 30, the present invention contemplates using three or more stems if desired. In one commercial embodiment of the present invention where base 22 was injection molded Lexan ®, plate portion 26 was about five-thirty seconds of an inch (5/32") thick and bores 32 were spaced apart two and one-eighth inches (2 ⅛"), center to center.

Eye plate 16 has a base portion 38, an outwardly extending loop eye 40 integral with the base 38 and a pair of openings 42 on each end of loop 40. Preferably the base portion 38 is the same size and shape as the gasket 20 and anchor base 22. The base 38 and loop 40 are preferably made of stainless steel or other metal plated with corrosion resistant material such as chrome. Gasket 20, has spaced apart holes 43 and is made of a pliable impermeable material to prevent leakage through the liner 14 to the pool wall 12.

To install the anchoring device, a pair of holes 44 that are large enough to receive stems 30, are made through the swimming pool wall 12 before the wall is backfilled. These holes 44 are preferably in the same horizontal plane and are at a distance equal to the distance between the stem portions 30 of anchor base 22. Accurate location of holes 44 can be achieved easily and repeatedly by using a template. The stem portions 30 of anchor base 22 are aligned with holes 44 from the interior of the swimming pool and pushed through wall 12. The threaded stem portions 30 on the exterior of wall 12 then receive washer 34 and wing nut 36. The wing nuts 36 are tightened down so that plate 26 is flush and tightly against the interior face of the swimming pool wall 12 and thus the base 22 is firmly fastened in place. When all anchoring devices 10 are installed on the swimming pool wall, dirt 45 is backfilled against the exterior or back side of the pool wall 12, covering wing nuts 36 and washers 34. Optionally, decking, such as concrete deck 8, may be poured over this backfill dirt 45 around the perimeter of the pool 6.

Once the anchor base 22 is tightly secured to the pool wall 12, the vinyl liner 14 is installed over the front plate portion 26 of anchor base 22. Holes 46 are then cut or punched through the vinyl liner 14 in alignment with bores 32. Gasket 20 is then placed against the exposed face of vinyl liner 14 with its holes 43 in alignment with bores 32. Eye plate 16 is then placed over gasket 20 with its pair of openings 42 in alignment with bores 32 so that screws 24 can be received through openings 42 and threaded into bores 32 in a self-tapping fashion. When screws 24 are tightened, eye plate 16 is firmly and fixedly mounted on the swimming pool wall i2. Safety rope 15 can later be installed by attaching rope hook 18 to loop 40 after the pool is filled.

When the pool liner 14 needs to be replaced, screws 24 are disengaged from bores 32 and eye plate 16 and gasket 20 is removed. Liner 14 then is replaced with a new liner and a new pair of holes 44 are punched in alignment with bores 32. Gasket 20 and anchor plate 16 are then reinstalled on the anchor base 22. This anchor device 10 allows for the quick replacement of pool liner 14 and easy reattachment of anchoring devices 10 and at the same time, provides a stable and secure support on the swimming pool wall. Stability and secure mounting of anchor device 10 is enhanced by providing two spaced-apart stems 30 extending through the wall 12. Hence, as contrasted to a single threaded fastener in certain prior art devices, the two fasteners can provide greater clamping forces. More importantly, because the stems 30 are spaced apart, the clamping forces can be distributed over a larger surface area and the base 22 and eye plate 16 effectively resist turning moments. With a single prior art fastener and concentrated clamping, the entire anchor is more easily rotated, twisted and canted so as to loosen from wall 12 and/or enlarge the single hole through the wall, in either case creating a wobbling anchor.

With the two stems 30 integral with the plate 26, the location of holes 44 in wall 12 can be preselected, as by a template, and then when base 22 is fastened in place, precise alignment of the bores 32 with the openings 42 eyeplate 16 is insured. Because screws 24 extend into stems 30, sufficient threadable engagement can be achieved to effectively secure plate 16 to base 22, even when base 22 is made of plastic. Although the anchoring device has been disclosed herein and is intended primarily for in-ground pools, if desired, it could also be used with above-ground pools. The anchor device 10 can be produced very economically by injection molding base 22. Loop anchors and gaskets, like anchor plate 16 and gasket 20, are available commercially for other applications. The use of molded plastic for anchor plate 16 eliminates rust and corrosion and seizing of mating parts, such as screw 24 in bore 32.

Figure 5:
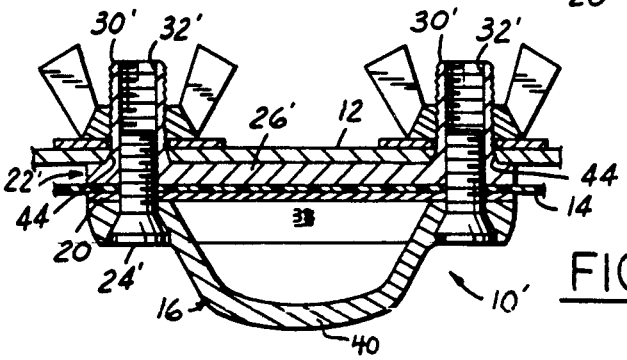
FIG. 5 is a sectional view, like FIG. 4, of a modification where the anchor base is cast and machined bronze.

FIG. 5 shows a modified anchor device 10′ where like parts are designated with like numbers and the modified parts have prime designations. In this embodiment, base 22′ is made of cast bronze that is machined and tapped to provide external and internal threads on stems 30′. Instead of self-tapping screws 24 (FIGS. 2–4), machine screws 24′ are threaded into internal threads of bore 32′ to fasten anchor plate 16 on base 22′. Except for base 22′ and screws 24′, the remaining parts correspond to those described in connection with FIGS. 2–4. Although a plastic base 22 and self-tapping screws 24 have been found to be more than adequate for most applications, a bronze base 22′ may be preferred by some architects for commercial pools.

It is also to be understood that the terminology employed in the description and claims incorporated herein, such as "front", "back", "interior", "exterior" etc., is used by way of description and not by way of limitation to facilitate understanding of the structure, function and operation of the combination of elements that constitute the present invention. Moreover, while the foregoing description and drawings illustrate in detail a preferred embodiment of the invention, to those skilled in the art to which the present invention relates, the present disclosure will suggest many modifications in construction, as well as widely differing embodiments and applications, without thereby departing from the spirit and scope of the invention. The present invention therefore is intended to be limited only by the scope of the appended claims and applicable prior art.

I claim:

1. In a method of installing a rope anchor device or the like to a wall of a swimming pool which has a replaceable liner, the steps of:

(a) making at least two holes through said wall with said holes being spaced apart a predetermined dimension corresponding to a dimension between two stems projecting rearwardly from a base plate of said anchor device, said base plate having at least two bores therein opening at an exposed face of said base plate and extending into a respective stem, (b) inserting said stems through said holes from a front of said wall to project said stems from a rear of said wall, (c) engaging at least two nuts on said stems to attach said base plate to said wall, (d) placing said pool liner over said exposed face of said base plate, (e) making at least two holes through said liner with each hole aligned with a respective bore, (f) placing over said liner a gasket having a dimension in one direction exceeding said predetermined dimension and having at least two openings through said gasket aligned with said two bores in said base plate, (g) mounting on said base plate an anchor plate having eyelet means and also having a dimension in one direction exceeding said predetermined dimension, said anchor plate being mounted on said base plate by:

(i) placing said anchor plate over said base plate with said liner and said gasket sandwiched therebetween, (ii) extending two threaded fasteners through said two openings, respectively, in said anchor plate, said gasket and said liner, and (iii) threadably engaging said two fasteners with said two bores, respectively, in said base plate stems so that when said fasteners are tightened, said anchor plate is firmly and fixedly mounted on said wall to resist turning movements of said anchor plate and with said liner clamped firmly between said anchor plate and said base plate, clamping forces are distributed over a surface area between said fasteners, said liner being easily replaced by removing said fasteners without having access to said back of said pool wall.

2. A rope anchor device for swimming pools having a wall and a liner, comprising in combination:

(a) a base plate having at least two stems integral with and projecting rearwardly from said base plate substantially perpendicular thereto, (i) said stems being spaced apart by a predetermined dimension and having a length such that free ends of said stems project through two holes in said swimming pool wall, (ii) at least two bores in said base plate opening interiorly of said pool when said stems are projected through said wall, one of said bores extending into one of said stems and another of said bores extending into another of said stems, (b) engaging means for interengaging free ends of said stems with a back of said wall to secure said base plate on said wall, (c) an anchor plate having eye means for receiving a swimming pool rope hook and at least two openings through said anchor plate, said anchor plate openings being spaced apart by said predetermined dimension and having a predetermined geometry relative to said eye means so that when said anchor plate is secured to said base plate, said eye means will have a predetermined final orientation, and (d) means for securing said anchor plate to said plate with said liner clamped firmly therebetween and with said eyelet means at said predetermined orientation, said securing means comprising at least two threaded fasteners engageable with said anchor plate and threadably engageable with said bores so that when said fasteners are tightened, said anchor plate is firmly and fixedly mounted on said wall to resist turning moments of said anchor plate and with said liner clamped firmly between said anchor plate and said base plate, clamping forces are distributed over a surface area between said fasteners, said liner being easily replaced by removing said fasteners without having access to the backside of said pool wall.

3. The anchor device set forth in claim 2 wherein said base is a one-piece part molded of plastic and said threaded fasteners are self-tapping screws.

4. The anchor device set forth in claim 2 wherein said base is a machined cast bronze part having said bores internally threaded to threadably receive said threaded fasteners.

5. The anchor device set forth in claim 2 wherein said stems are externally threaded and said engaging means comprises at least two washers receivable on said stems and a pair of nuts threadably engageable with said stems.

* * * * *